United States Patent [19]

Glass

[11] 4,444,328

[45] Apr. 24, 1984

[54] TAMPER-RESISTANT PACKAGING ARRANGEMENT

[75] Inventor: Henry P. Glass, Northfield, Ill.

[73] Assignee: Martin Abrams, Chicago, Ill.

[21] Appl. No.: 469,989

[22] Filed: Feb. 25, 1983

[51] Int. Cl.[3] ..... B65D 55/12

[52] U.S. Cl. ..... 215/230; 215/313; 222/548

[58] Field of Search ..... 215/230, 307, 313; 222/548

[56] References Cited

U.S. PATENT DOCUMENTS 3,042,273 7/1962 Bauer et al. ..... 222/548

3,718,239 2/1973 Cochran ..... 222/548

*Primary Examiner*—Donald F. Norton

*Attorney, Agent, or Firm*—Dressler, Goldsmith, Shore, Sutker & Milnamow, Ltd.

[57] ABSTRACT

A tamper-resistant packaging arrangement is disclosed which includes a container having a top wall portion defining a container opening, and a closure adapted to be non-removably fitted to the container, and which includes a top wall portion defining a closure opening. The closure is adapted to be fitted to the container and retained threon in a first, unopened position in which the closure opening and the container opening are out of alignment and the container is closed. A coacting arrangement is provided whereby the closure is initially maintained in its first position, and which prevents the closure from being moved back into its first position after it is moved therefrom by relative rotation. The packaging arrangement preferably includes suitable indicia on at least one of the closure and the container to provide a clear visual indication of disposition of the closure in its first, unopened position with respect to the container. When access to the contents of the container is desired, the closure can be easily relatively rotated and moved from its first position for alignment of the closure and container openings, with the arrangement thereafter still functioning to close the container is desired. However, after initial opening the container, the closure can no longer be returned to its first position with respect thereto.

12 Claims, 4 Drawing Figures

CAPE
SKIN

TAMPER-RESISTANT PACKAGING ARRANGEMENT

TECHNICAL FIELD

The present invention relates generally to tamper-resistant packaging arrangements, and more particularly to an arrangement including a container and a closure adapted to cooperate with each other so that after initial opening of the container, the closure can no longer be positioned in its initial, unopened position.

BACKGROUND OF THE INVENTION

For many food and non-prescription drug items, it is very desirable to provide packaging which is tamper-resistant so that a consumer is assured that an item is in its original, unopened package, and that the contents of the package are unadulterated. It is usually preferred to provide an arrangement whereby a purchaser can readily visually discern the unopened condition of the package.

It is also desirable that tamper-resistant packaging arrangements be readily adaptable for economical fabrication and use. Accordingly, the construction of such an arrangement should be as straightforward as possible. Further, it is preferable that such arrangements do not substantially hamper the ease with which the package may be opened after purchase, and do not interfere with normal opening and closing of the package thereafter.

The present invention provides the above-desired qualities, and is particularly suited for embodiment as a container and closure arrangement wherein the closure remains on the container after initial application thereto, with the closure being relatively movable for opening and closing the container.

SUMMARY OF THE INVENTION

The present tamper-resistant packaging arrangement preferably comprises a container, and a closure adapted to be fitted to and retained on the container. The invention contemplates that the closure is initially fitted to the container in a first, unopened position, with visual indicia preferably provided on at least one of the closure and the container for clearly visually indicating the disposition of the closure in its frrst position with respect to the container. In order to gain access to the contents of the package, the closure is relatively moved with respect to the container, preferably by relative rotation, which permits alignment of openings respectively defined by the closure and the container. Significantly, after movement from its first, unopened position, the closure can no longer be moved back into its first position. Thus, a purchaser can very easily visually discern whether or not the packaging arrangement has been opened.

In the preferred embodiment, the present packaging arrangement includes a container having a neck portion and a container top wall portion defining a container opening. The arrangement further includes a closure having a top wall portion defining a closure opening, and an annular skirt portion depending from the top wall portion.

In accordance with the invention, first and second coacting arrangements are provided on the closure and the container. The first coacting arrangement is adapted for retaining the closure on the container, and for permitting relative movement therebetween, preferably by relative rotation. The first coacting arrangement preferably comprises one or more first projections provided on one of the closure and the container, and means for receiving and cooperating with the projections on the other of the closure and container. In the illustrated embodiment, a pair of inwardly extending first projections are provided on the inside surface of the closure skirt portion which are adapted to be respectively received by undercut portions defined by the neck portion of the container.

In order to facilitate initial application of the closure to the container by generally axial movement of the closure, a cam arrangement is preferably provided to facilitate positioning of the first projections in association with the undercut portions of the container.

The present invention further contemplates that a second coacting arrangement is also provided on the closure and the container. Notably, the second coacting arrangement is adapted to initially maintain the closure in its initially closed first position with respect to the container. In this first position, the openings respectively defined by the closure and the container are out of alignment, with the top wall portion of the closure closing the container opening. The second coacting arrangement preferably comprises a one-way cam arrangement which permits the closure to be relatively moved from its first position, and which prevents the closure from being returned to its first position by relative movement in an opposite direction.

In order to prevent movement of the closure back into its first position after relative movement therefrom in a first direction, stop means are provided to prevent continued relative movement of the closure in the first direction back into its first position. The stop means are preferably adapted to coact with one or more of the first projections of the first coacting arrangement provided on one of the closure and the container, and accordingly are provided on the other of the closure and the container. In the illustrated embodiment, the stop means comprise one or more stops provided on the container in respective association with its undercut portions, and which are adapted to be respectively engaged by the one or more first projections provided on the skirt portion of the closure.

Numerous other advantages and features of the present invention will become readily apparent from the following detailed description of the invention and embodiment thereof, from the claims and from the accompanying drawings.

DETAILED DESCRIPTION

Figures 1, 2, 3, 4, 5:
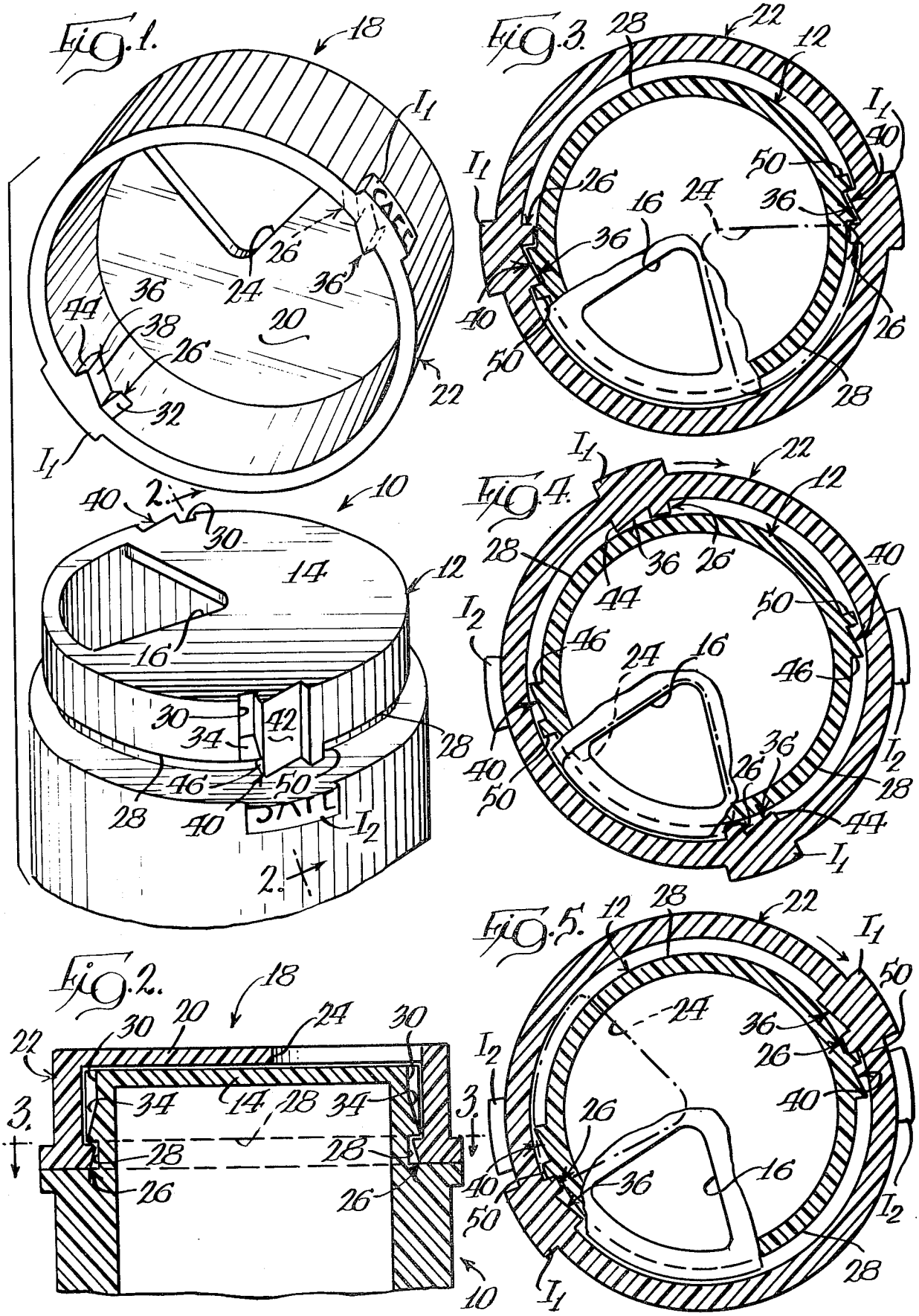
FIG. 1 is an exploded, perspective view of the present packaging arrangement illustrating the closure and the container of the arrangement prior to application of the closure to the container.
FIG. 2 is a cross-sectional view taken generally along lines 2—2 of FIG. 1 illustrating the present packaging arrangement after application of the closure to the container.
FIG. 3 is a horizontal cross-sectional view of the present packaginq arrangement taken generally along line 3—3 of FIG. 2 illustrating the closure in its initial, unopened first position with respect to the container.
FIG. 4 is a cross-sectional view similar to FIG. 3 illustrating the present packaging arrangement after relative movement of the closure from its first, unopened position with respect to the container.
FIG. 5 is a cross-sectional view similar to FIGS. 3 and 4 further illustrating the coaction of the closure and the container of the present arrangement, with the closure illustrated in a closed position with respect to the container.

While the present invention is susceptible of embodiment in various forms, there is shown in the drawings and will hereinafter be described a presently preferred embodiment, with the understanding that the present disclosure is to be considered as an exemplification of the invention and is not intended to limit the invention to the specific embodiment illustrated.

Referring now to FIG. 1, therein is illustrated the present tamper-resistant packaging arrangement. As will be recognized, the present arrangement can be readily fabricated from suitable plastic materials for economy, ease of manufacture, and ease of use by consumers.

The present arrangement includes a container 10 (partially illustrated in FIG. 1) having a neck portion 12 and a top wall portion 14 connected to the neck portion. Top wall portion 14 defines a container opening 16 which provides access to the interior of the container.

The present arrangement further includes a unitary, preferably one-piece closure 18 which is adapted to be fitted to container 10 in a non-removable manner. Closure 18 includes a top wall portion 20 from which depends an annular skirt portion 22. Top wall portion 20 defines a closure opening 24 which, as will be further described, is adapted for selective alignment with container opening 16 to permit the container to be opened and closed.

In accordance with the present invention, a first coacting arrangement is provided on the closure and the container for retaining the closure on the container and for permitting relative movement therebetween. The first coacting arrangement preferably includes one or more projections on one of the closure and the container, with the other of the closure and container including means for receiving the projections for cooperation therewith. Accordingly, a pair of first, inwardly extending projections 26 are provided on the inwardly facing surface of skirt portion 22 of closure 18. Attendant to application of the closure to the container, projections 26 are adapted to be respectively received generally within circumferentially extending undercut portions 28 defined by the container neck portion 12. In the illustrated embodiment, a pair of undercut portions 28 are provided, with first projections 26 being respectively receivable within the undercut portions.

In order to facilitate application of the closure 18 to container 10 by generally axial movement of the closure with respect thereto, container neck portion 12 preferably defines one or more application slots 30 through which projections 26 are adapted to respectively pass during closure application.

In order to further facilitate correct positioning of first projections 26 in association with undercut portions 28 of container neck portion 12 attendant to axial movement of the closure onto the container, at least one of slots 30 and first projections 26 include cam surfaces to guide the projections 26 into the undercut portions 28. In the illustrated embodiment, each of projections 26 includes a vertically inclined cam surface 32, and each of slots 30 includes a generally complemental, vertically inclined cam surface 34. Cam surfaces 32 and 34 are adapted to respectively engage each other attendant to application of closure 18 to container 10 such as by "press-fitting." As the respective cam surfaces 32 and 34 engage each other, the container 10 and/or the closure 18 are subjected to resilient deformation so that projections 26 slip from their respective slots 30, and move into a coacting disposition within undercut portions 28. When this occurs, the closure and the container generally resume their original configuration, with projections 26 acting in cooperation with undercut portions 28 to prevent the closure from being removed from the container without permanent deformation of either the closure or the container. Thus, the action of applying closure 18 to container 10 is in the nature of a "snap-fit."

When closure 18 is initially fitted to container 10 as described above, the closure is retained on the container in a first position with respect thereto, as illustrated in FIGS. 2 and 3. In this first position, container opening 16 and closure opening 24 are out of alignment such that top wall portion 20 of the closure closes container opening 16, as best illustrated in FIG. 3 (it will be noted that in FIGS. 3, 4, and 5, the relative positions of container opening 16 and closure opening 24 are respectively shown in solid line and phantom line, and that these openings are disposed above the plane of the cross-sectional views of these figures.).

In order to provide a visual indication to a consumer that the present packaging arrangement is in an unopened condition, suitable indicia are preferably provided on at least one of closure 18 and container 10 for clearly visually indicating the disposition of the closure 10 in its first position with respect to the container. Accordingly, one or more indicators, designated $I_1$, are provided on closure 18, with a corresponding number of indicators, designated $I_2$, provided on container 10. In the first, unopened position of closure 18 on container 10, the respective ones of indicators $I_1$ and $I_2$ are aligned, and may be configured such that they together spell a word such as "safe" or the like. Naturally, other suitable indicating arrangements can also be employed, such as suitable color coding, labeling, or the like.

In accordance with the present invention, the present packaging arrangement is configured such that closure 18 is releasably maintained in its first position with respect to closure 10, and cannot be returned to its first position after the closure is relatively moved therefrom without permanent deformation of the arrangement. To this end, a second coacting arrangement is provided on the closure and the container which functions as a one-way cam mechanism. The cam mechanism is preferably provided by one or more cam projections 36 provided on closure 18, each of which has a generally inwardly facing cam surface 38. The one-way cam mechanism further includes a corresponding number of cam projections 40 provided on container neck portion 12, each including a generally outwardly facing cam surface 42. When closure 18 is initially applied to container 10, the respective cam surfaces of projections 36 and 40 are positioned in generally confronting relation, as best illustrated in FIG. 3 which shows closure 18 in its first position with respect to container 10 (note that openings 16 and 24 are out of alignment).

The cooperation of cam projections 36 and 40 initially and releasably maintains closure 18 in its first position with respect to container 10. In order to gain access to the contents of the container, closure 18 manually is moved with respect to container 12 bv relative rotation. Attendant to the relative rotation of closure 18 in a first direction from its first position (clockwise referring to the orientation of the drawings), the respective cam surfaces of cam projections 36 and 40 "ride up" against each other until the cam surfaces are clear of each other. Relative rotation of the closure with respect to the container is facilitated by the movement of first projections 26 within undercut portions 28, with the projections 26 continuing to cooperate with the undercut portions to retain closure 18 on container 10.

As closure 18 is moved from its first position, indicators $I_1$ and $I_2$ are moved out of alignment, thus providing a clear visual indication that the closure is no longer in its unopened position on the container. As will be appreciated, movement of closure 18 from its first position will result in some resilient deformation of container neck 12 and/or closure skirt portion 22 due to the coaction of cam surfaces 38 and 42 of cam projections 36 and 40. The fabrication of either one or both of closure 18 and container 10 from plastic material permits such deformation to resiliently take place without permanent damage to the closure or container.

As closure 18 is moved from its first, unopened position by relative rotation, the closure may easily be moved into a second open position such that closure opening 24 and container opening 16 are aligned to gain access to the contents of the container as shown in FIG. 4. It will be observed that the configuration of cam projections 36 and 40 prevents closure 18 from being relatively rotated in an opposite direction back into its first, unopened position, with the configuration of cam projections 36 and 40 including respective reverse lock surfaces 44 and 46 (see FIGS. 1 and 4) which are adapted to engage each other if the closure is rotated in an opposite direction toward its first position. Thus, after the closure is initially opened by relative rotation in a first direction, the closure can no longer be returned to its first position by rotation in an opposite direction.

In order to prevent closure 18 from being moved back into its first position by continued rotation in the first direction (clockwise referring to the orientation of the drawings), a positive stop arrangement is provided. Specifically, a pair of stop projections 50 are provided in respective association with undercut portions 28 on container neck 12, with stops 50 being adapted to be respectively engaged by first projections 26 if closure 18 is relatively rotated further in its first direction of movement from its first position. This coaction is illustrated in FIG. 5 wherein projections 26 on skirt portion 22 of the closure are illustrated in respective engagement with stops 50 on container neck portion 12. It will be observed that stops 50 prevent alignment of indicators $I_1$ and $I_2$, and thus further prevent the closure from being returned to its first unopened position after it is moved therefrom. Thus, FIG. 5 illustrates the closure 18 in its closed position with respect to the container 10, with the top wall portion 20 of the closure covering and closing container opening 16.

As will be recognized from the foregoing description of the present invention, many modifications of the illustrated embodiment can be effected. For example, while container opening 16 and closure opening 24 have both been shown as generally pie-shaped, one or both of the openings can comprise a perforation (i.e., a multiplicity of holes) which can be desirable for dispensing granulated contents from the packaging arrangement. Naturally, the openings 16 and 24 can be variously sized depending upon the nature of the contents of the arrangement, so long as the openings are unaligned in the first position of the closure with the top wall portion 20 of the closure covering and closing container opening 16. It will also be recognized that the configuration and positioning of the coacting elements of the packaging arrangement can be varied in accordance with the teachings herein.

From the foregoing, it will be observed that numerous variations and modifications may be effected without departing from the true spirit and scope of the concept of the present invention. It will be understood that no limitation with respect to the specific embodiment illustrated herein is intended or should be inferred. It is, of course, intended to cover by the apoended claims all such modifications as fall within the scope of the claims.

What is claimed is:

1. A tamper-resistant packaging arrangement, comprising:

a container having a container opening;

a closure having a top wall portion defining a closure opening, and an annular skirt portion depending from said top wall portion; and coacting means on said closure and said container for retaining said closure on said container and for initially maintaining said closure in an initially closed first position with respect to said container after application of said closure thereto, said container opening and said closure opening being out of alignment in said first position so that said too wall portion closes said container opening, said coacting means permitting relative movement of said closure from said first position to permit alignment of said closure opening and said container opening in a second open position, said coacting means preventing relative movement of said closure to said first position after movement therefrom.

2. The tamper-resistant packaging arrangement in accordance with claim 1, wherein said coacting means includes first coacting means on said closure and said container for retaining said closure on said container and for permitting relative movement therebetween, and second coacting means on said closure and said container for initially maintaining said closure in said first position and for preventing opposite relative movement of said closure into said first position after relative movement of said closure from said first position.

3. The tamper-resistant packaging arrangement in accordance with claim 2, wherein said first coacting means comprises first projection means on one of said container and said closure, and projection receiving means on the other of said closure and said container, said receiving means being adapted to receive said first projection means when said closure is applied to said container.

4. The tamper-resistant packaging arrangement in accordance with claim 3, including first cam means for facilitating positioning of said first projection means in association with said receiving means attendant to generally axial movement of said closure onto said container when said closure is applied to said container.

5. The tamper-resistant packaging arrangement in accordance with claim 3, wherein said second coacting means comprises one-way cam means adapted to releasably maintain said closure in said first position on said container and adapted to prevent opposite relative movement of said closure into said first position after relative movement of said closure therefrom.

6. The tamper-resistant packaging arrangement in accordance with claim 5, wherein said coacting means further comprises stop means adapted to coact with said first projection means, said stop means being provided on the other of said closure and said container, and being adapted to engage said first projection means to prevent continued relative movement of said closure into said first position after relative movement therefrom in a first direction.

7. A tamper-resistant packaging arrangement, comprising:

a container having a neck portion and a container top wall portion defining a container opening;

a closure having a closure top wall portion defining a closure opening, and an annular skirt portion depending from said closure top wall portion;

first coacting means for retaining said closure on said container and for permitting relative rotational movement of said closure with respect to said container to permit alignment of said closure and container openings, said first coacting means comprising first projection means extending inwardly of said skirt portion of said closure, and means on said container for receiving said first projection means comprising undercut means defined by said neck portion; and second coacting means on said closure and said container for initially and releasably maintaining said closure in a first position with respect to said container wherein said container opening and said closure opening are unaligned and said closure top wall portion closes said container opening, said second coacting means comprising one-way cam means adapted to permit said closure to be relatively rotated from said first position in a first direction, and adapted to prevent opposite relative rotational movement of said closure back into said first position after movement therefrom.

8. A tamper-resistant packaging arrangement in accordance with claim 7, including cam means for facilitating application of said closure to said container by generally axial movement so that said first projection means are received by said undercut means.

9. A tamper-resistant packaging arrangement in accordance with claim 7, including slot means defined in said neck portion within which said first projection means are movable attendant to application of said closure to said container by generally axial movement, at least one of said slot means and said first projection means including cam surface means to guide said first projection means into said undercut means on said container.

10. The tamper-resistant packaging arrangement in accordance with claim 9, wherein said one-way cam means comprises at least one cam projection on each of said closure and said container, said cam projections being adapted to be positioned in confronting relation in said first position of said closure.

11. The tamper-resistant packaging arrangement in accordance with claim 10, including stop projection means defined by said neck portion and disposed in association with said undercut means whereby after movement of said closure from said first position in said first direction, said first projection means are adapted to engage said stop means to prevent movement of said closure into said first position attendant to further relative movement of said closure in said first direction.

12. The tamper-resistant packaging arrangement in accordance with claim 11, including means on at least one of said closure and said container for visually indicating disposition of said closure in said first position on said container.

* * * * *